United States Patent [19]

Luckstead

[11] Patent Number: 4,838,453

[45] Date of Patent: Jun. 13, 1989

[54] PILL DISPENSER

[76] Inventor: Jon D. Luckstead, R.R. 2, Bellevue, Iowa 52031

[21] Appl. No.: 155,789

[22] Filed: Feb. 16, 1988

[51] Int. Cl.[4] ..... B65D 83/04

[52] U.S. Cl. ..... 221/2; 221/12; 221/15; 221/83; 221/86

[58] Field of Search ..... 221/2–4, 221/9, 12–13, 15, 82–83, 86, 89, 91, 194, 289

[56] References Cited

U.S. PATENT DOCUMENTS 3,558,003 1/1971 Jones ..... 221/2

4,674,651 6/1987 Scidmore et al. ..... 221/15 X

FOREIGN PATENT DOCUMENTS 1923302 2/1971 Fed. Rep. of Germany ..... 221/2

*Primary Examiner*—Charles A. Marmor

*Attorney, Agent, or Firm*—Henderson & Sturm

[57] ABSTRACT

The disclosed pill dispenser is of the disc or carousel type and has a base provided with a flat top over which the disc is superimposed so that the bottom face of the disc is so closely proximate to the top face of the base as to prevent the gravitational escape of pills, tablets, capsules, etc. from vertical pill containing pockets in the disc except via a controlled radial slot having a gate timed with rotation of the disc on the basis of a predetermined number of dosage periods per day and a predetermined number of days according to a power source in the form of a clock motor, for example. In a preferred form of the invention the gate-controlled slot depends upon the spirally arranged pattern of the dosage pockets and the gate moves in the slot in accordance with a like spiral track. Each pocket is capable of containing a plurality of pills; e.g., in instances in which multiple pills of different types are prescribed.

13 Claims, 3 Drawing Sheets

PILL DISPENSER

BACKGROUND AND SUMMARY OF THE INVENTION

The prior art abounds with examples of rotary and like pill dispensers but these, in the main, suffer from one or more drawbacks resulting from the multiple requirements that the instrument be simple, convenient, low-cost, durable and capable of functioning over an extended period of time divided into dosage intervals and particularly wherein the intervals require more than one kind of pill, tablet, capsule, etc.

According to the present invention, the foregoing and other drawbacks are eliminated by a novel construction in which the dispenser is capable of dispensing pills, etc. of different types at selected time divisions of a plurality of days. For example, in an eight-day embodiment wherein each day is divided into four time divisions or intervals, the dispenser will dispense at six hour intervals every day for several days, after which the dispenser is "re-loaded" for subsequent multi-day operations. The dispenser disc contains a plurality of sets of pill-containing or dosage pockets arranged on successive curves of a mono-plane spiral that proceeds centrifugally from the vertical center of rotation of the disc. The dispenser is simplified by the use of the flat top of the base as a means for preventing dropping of pills except at predetermined time and day intervals, the control of which derives from the provision in the top of the base of a radial slot normally closed by a progressively moving gate timed with rotation of the disc.

A significant feature of the invention is that notice to the user that all pills of a particular dose have been dispensed and the correct time for consumption has arrived is provided by a signal such as an indicator light or sound generating device that is activated by a suitable means such as a mercury switch. The switch time setting is adjustable for a period of several hours after the pills have been dispensed; for instance, at 5:30, 6:00, 6:30, 7:00 and 7:30 in the morning. The switch is moved to an on position by rotation of a shaft that couples the mercury switch and a magnet which turns the shaft when it is attracted to an iron insert that is placed in a desired time setting slot provided in the circumference of the pill dispensing disc. Reset of the switch is accomplished by a push button attached to a nonferrous shaft that merely pushes the magnet back to its rest position.

The foregoing and other important objects and features of the invention will be gathered from the ensuing disclosure of a preferred embodiment of the invention.

DETAILED DESCRIPTION OF A PREFERRED EMBODIMENT OF THE INVENTION

Figure 1:
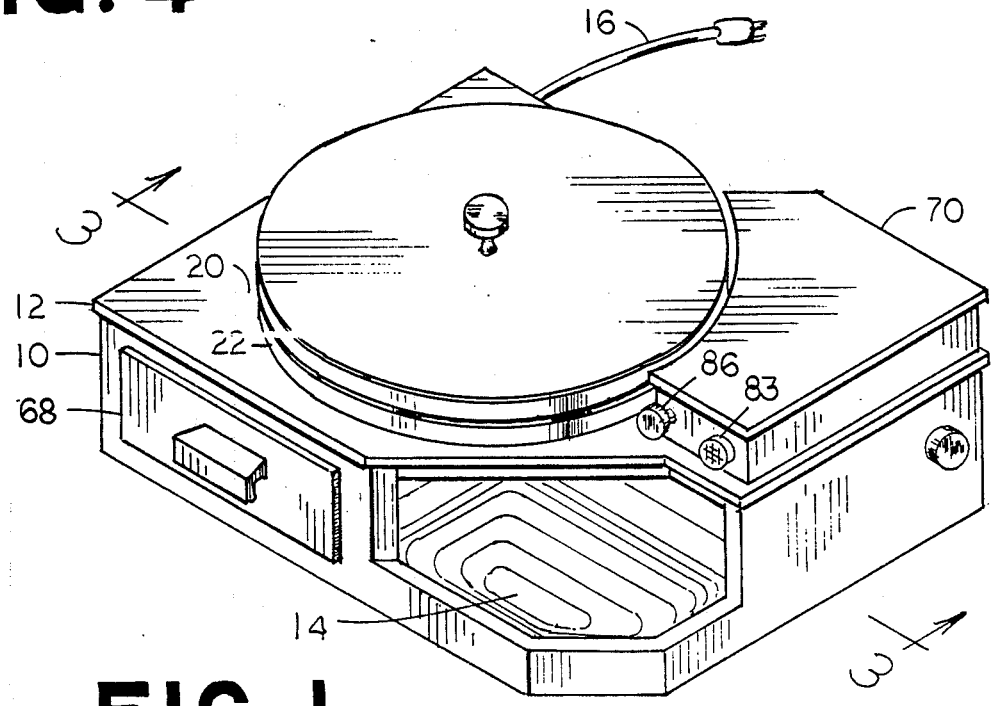
FIG. 1 is a small-scale perspective of the apparatus as seen with the dispensing disc covered.
Figure 2:
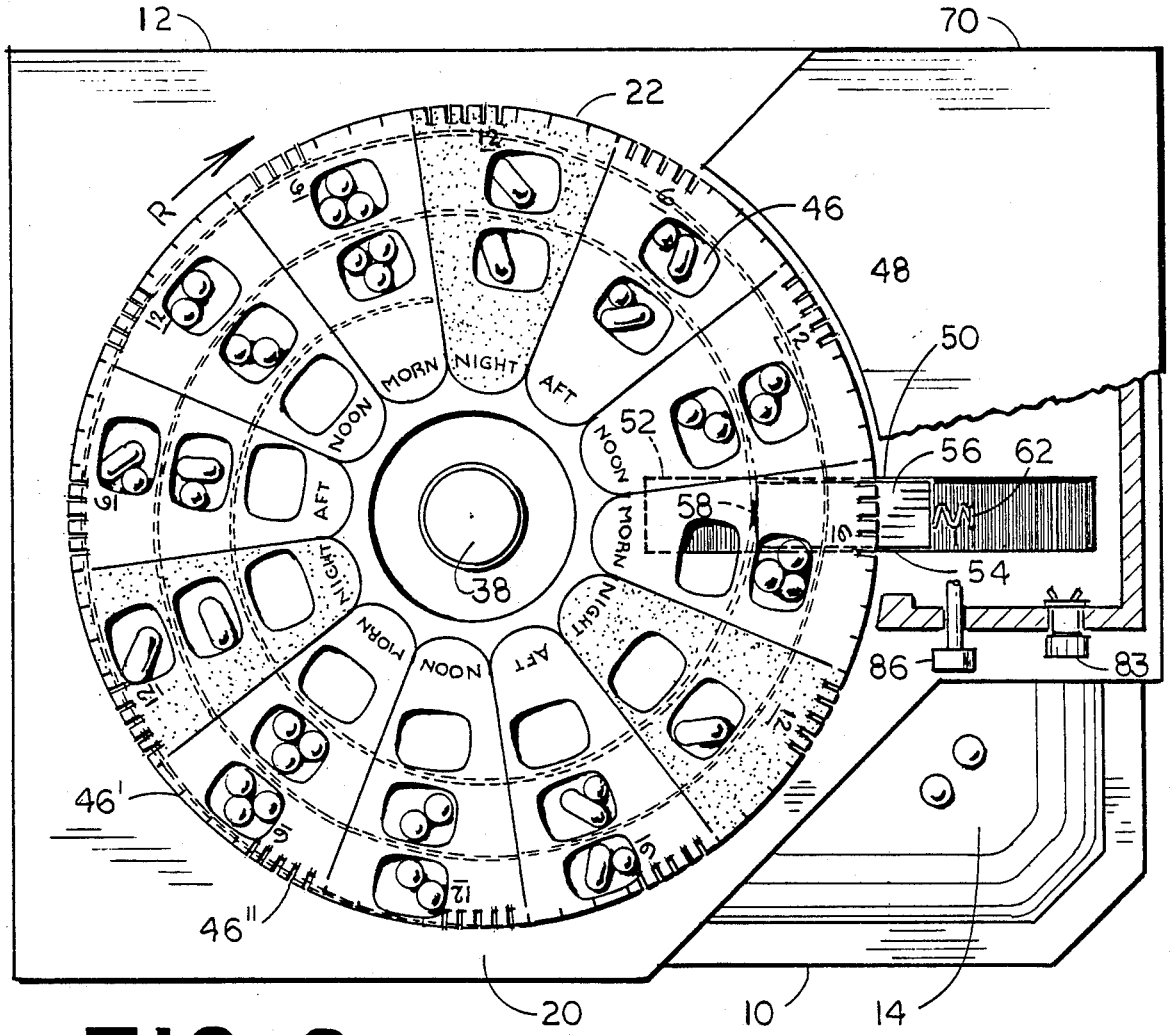
FIG. 2 is an enlarged plan view with the disc cover removed and with portions of the signal means broken away and omitted.

FIG. 1 will be referred to first as presenting a general picture of the machine or apparatus. The dispenser comprises essentially a rectangular base 10 having a top 12 that normally covers the base and base-supported components. The numeral 14 designates a tray into which pills are delivered. The numeral 16 indicates a power cord for energizing means for driving the basic movable part of the dispenser.

The base is primarily hollow and may be constructed of any suitable material, such as any of the known rigid plastics. The top may be likewise constructed. The base has a flat top 20 over which is closely superimposed a disc or carousel 22, here circular about a vertical axis and rotatable on the base by means of a vertical shaft 24 driven by driving means in the form of an electric clock motor 32 to which current is supplied via the power cord 16 previously described. It should be noted, however, that the specific type of drive means is not a limitation on the scope of the invention, since any form of drive means may be utilized for driving the disc at a pre-selected constant rate and direction. Likewise, the motor may be supported within the base in any desired mode.

The manner of connecting the disc 22 to the shaft 24 is preferably of the type enabling the motor to overrun the disc in the event the disc becomes hung up for any reason and also enabling manual reverse angular movement of the disc relative to the motor, as when re-setting the disc. To this end, then, the upper end of the shaft 24 is threaded at 34 and passes loosely through a central bore 36 in the disc. An external knob 38, for example, is threaded onto the threaded end of the shaft 24. The knob is tightened sufficiently to establish normal rotation of the disc but will allow slippage under conditions requiring a slip clutch. Likewise, retrograde rotation of the disc, as by hand, is permitted relative to the motor, as when it is desired to reset the disc.

Figure 3:
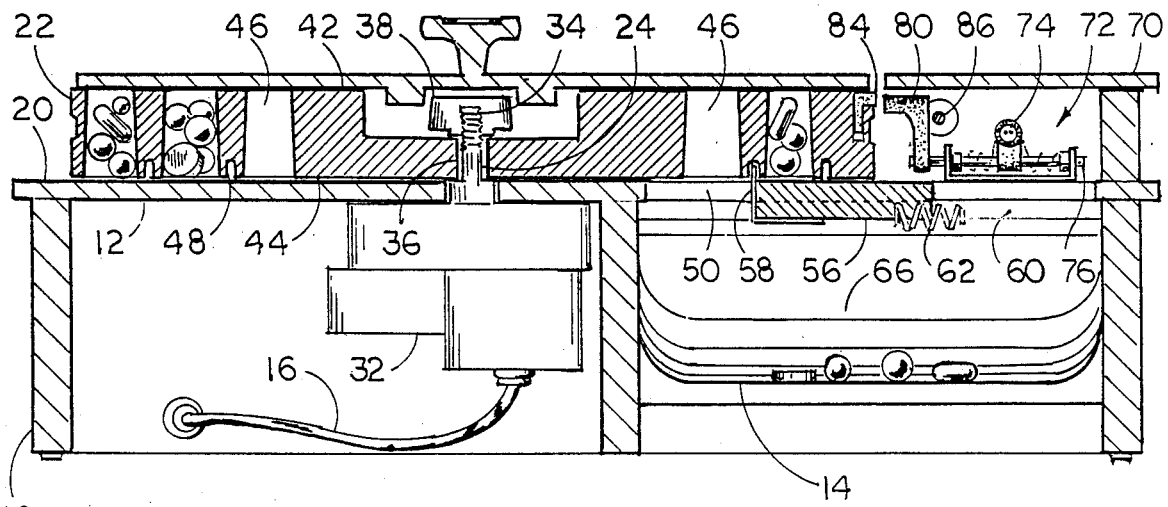
FIG. 3 is a section, drawn to an enlarged scale as respects FIG. 1 and taken generally along the line 3—3 of FIG. 1.

The disc has flat, parallel top and bottom surfaces 42 and 44, respectively, and the bottom runs closely over the top surface of the base as best seen in FIG. 3. In a presently preferred embodiment of the invention, the disc may be on the order of ten and one half inches in diameter and has a vertical thickness of about one and one-quarter inches. From the foregoing dimensions, the overall size of the machine may be seen; although, the specific dimensions are not to be taken as limitations on the invention. Likewise, the material of which the disc is made is not a limitation, and any appropriate material may be used; e.g., molded plastic or the like.

The disc is designed to hold several pills, tablets, capsules and the like and the term "pills" is to be considered as embracing pill equivalents. The pills will be retained or carried in a plurality of vertical pockets 46, here shown as being rectangular in section to accommodate elongated capsules. In any event, each pocket extends completely through the disc from top to bottom and pills are loaded from above. The pills cannot immediately escape from the bottoms of the pockets because the vertical clearance between the bottom of the disc and the flat top of the base is considerably less than the smallest of the contemplated pills. Gravitational escape of the pills is via control means that will presently appear. For the moment, reference will be made to the pattern of the pockets in the disc.

Figure 5:
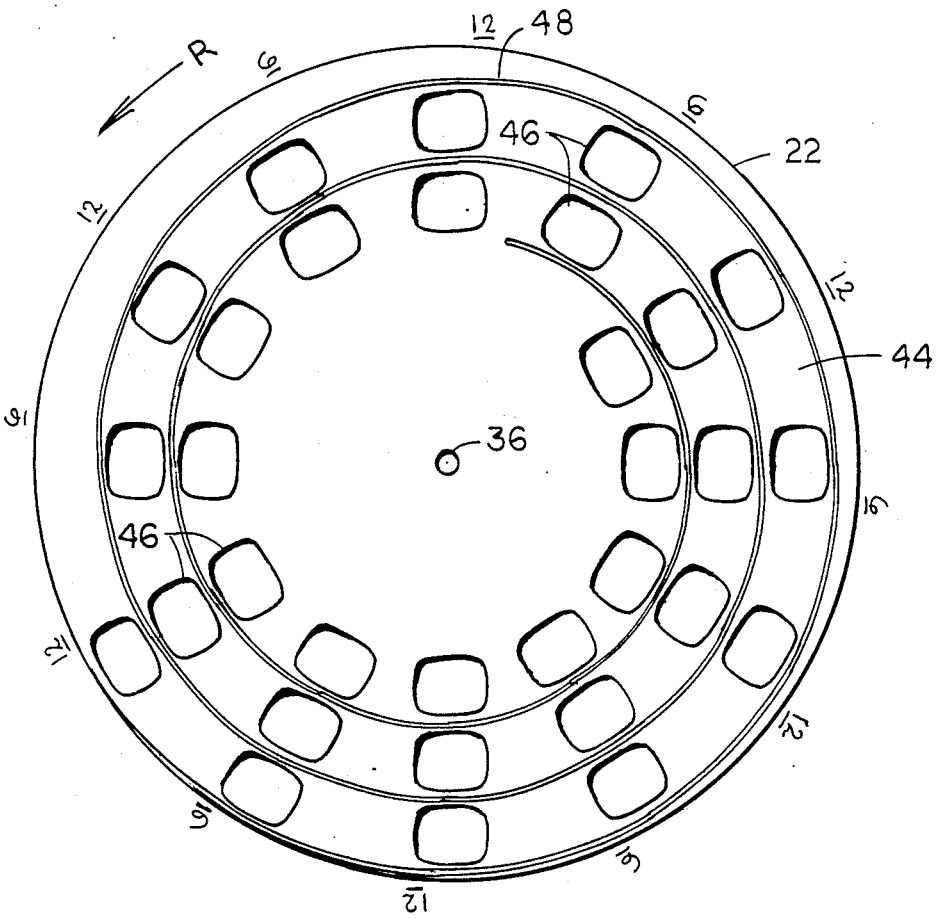
FIG. 5 is a bottom view of the disc and shows the control spiral.
Figure 6:
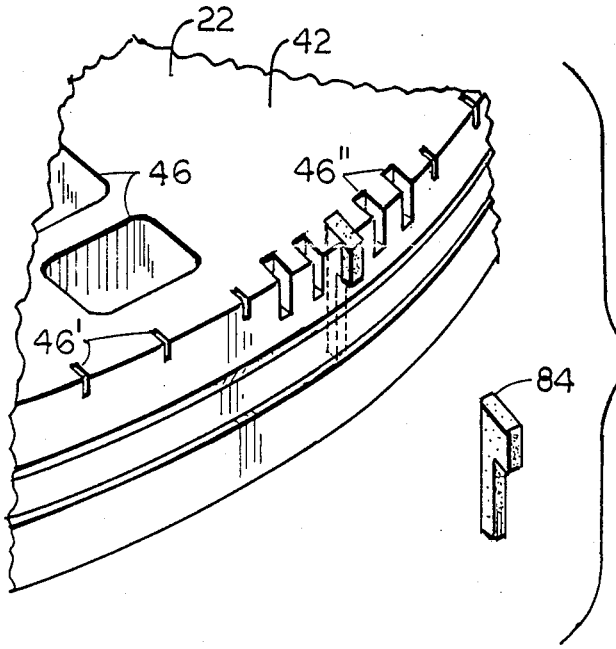
FIG. 6 is a fragmentary perspective showing the selectivity of part of the signal means.

FIG. 5 best shows this pattern or arrangement of the pockets as based on a mono-plane spiral starting adjacent to the center of the disc and progressing centrifugally. In order to render the explanation of this pattern readily comprehensible, a spiral 48 will be used as the background; although, this spiral does not intersect the axis of the pockets 46 but is part of the preferred example of dispensing control means to be described subsequently. Nevertheless, the spiral pattern of the pockets and the spiral 48 are "parallel" as will appear later herein.

The following description will proceed on the basis that the overall time involved is eight days, broken down into four time division or dispensing intervals per day; although, it will be clear that other times and intervals may be resorted to. In the present case, the sets of time intervals are shown in circular array about an inner part of the disc as "NOON", "AFT", "NIGHT" and "MORN", each set a 24-hour period. At this point it should be observed that there are thirty pockets rather than thirty-two. But the disc rotation starts ahead of a first pocket and ends after the last pocket and is restarted. Moreover, variations in the diameter of the disc can result in more or fewer pockets and the term "eight-day" is not a limitation on the invention. In the drawings by way of illustration, the numerals 12 and 6 appear about the periphery of the disc. Additional indicia are also shown on the dis itself, single radial marks or "nicks" as at 46', representing one hour intervals and double radial marks or slots 46" representing half-hour intervals. Now, having regard to the arrow R that shows the direction of rotation, one can readily determine fractional hours; e.g., 12:30 p.m., 6:30 a.m.; or times other than 12 and 6; e.g., 1 p.m., 7 p.m., 1 a.m., etc.

Considering now the day-to-day succession of the pocket arrangement it will be clear that each day includes the set of four pockets (NOON, AFT, NIGHT, MORN) in that arc of the spiral closest to the center of the disc, identified here as the next succeeding set of four pockets lies in the adjacent "curve" of the spiral and so on. Also, the time divisions of the days are alined respectively on radii of the disc. For example, all "NOONS" lie on one radius, all "MORNS" on another, etc.

As previously described herein, the bottom-most pill in each pocket 46 may be said to ride on the top flat surface of the base until the first pocket reaches the dispensing area, here including a radial slot 50 that intersects the curves of the spiral and that has an inner end 52 adjacent to the center of the disc and an outer end 54 proximate to the periphery of the disc. The slot has a width on the order of the dimension of the disc pockets. The dimensional relationship and the angular spacing between pockets in each set prevent simultaneous dispensing of pills from multiple pockets. The dispensing control means, including the slot 50, also includes a sliding gate 56 fitting the slot and of such length as to block the slot when in its starting position; that is to say, the top of the closed gate is flush with and gives the top of the base an unbroken surface. However, the gate is movable progressively radially outwardly from its inner or starting position to its outer position, thereby to open the slot progressively to the bottoms of pockets as the disc turns, beginning with the first pocket in Day 1 through the final pocket in Day 8. It will be seen that as the gate moves to uncover a pocket and to thereby cause gravitational discharge of a pill, the bottom of that pocket, even though crossing the open slot several times in an eight-day period, has no more pills to dispense and the crossing of the slot occurs idly.

The control means for regulating the movement of the gate lengthwise of the slot as just described includes, in the preferred inventive embodiment, the spiral 48 previously described in connection with the description of the spiral pattern of the pockets 46. This spiral 48 takes the form of a groove or track in the bottom face of the disc for receiving a track follower 58 fixed to and projecting upwardly from the gate. Since the gate is guided linearly in the slot 50, as by track means 60, the requisite precision is achieved as the gate moves progessively from its inner position to its outer position. When the gate reaches its outer position, resilient means 62 abuts the adjacent base wall and biases the gate inwardly so that the track follower rides on the circular periphery of the disc. This arrangement enables the disc to continue to rotate without causing further movement of the gate. When the disc is reversed manually, as for resetting the apparatus, the gate follower will track in the spiral groove 48 until its inner position is attained; that is, ready to begin movements radially outwardly on the next eight-day cycle of the dispensing means.

The dispensing slot 50 opens downwardly to a base-contained receiving means or chute 66 which exits to a tray 14. A drawer 68 is shown next to the tray for containing stored pills, etc.

A further feature of the invention is the provision of signal means for designating the dispensing of a selected dosage of pills, etc. In the present case, the signal means is of the visible type but obviously could be audible or a combination of both. In the preferred embodiment a casing or housing 70 is provided at one corner of the base and contains switch mechanism 72 that includes a mercury switch 74 rockable on a cross shaft 76 carried by a bracket 78. A magnet 80 is fixed to the disc-proximate end of the shaft. Electrical leads 82 are shown as means for supplying current to the switch. The switch is of the type that rocks over center to cause illumination of a lamp 83.

Figure 4:
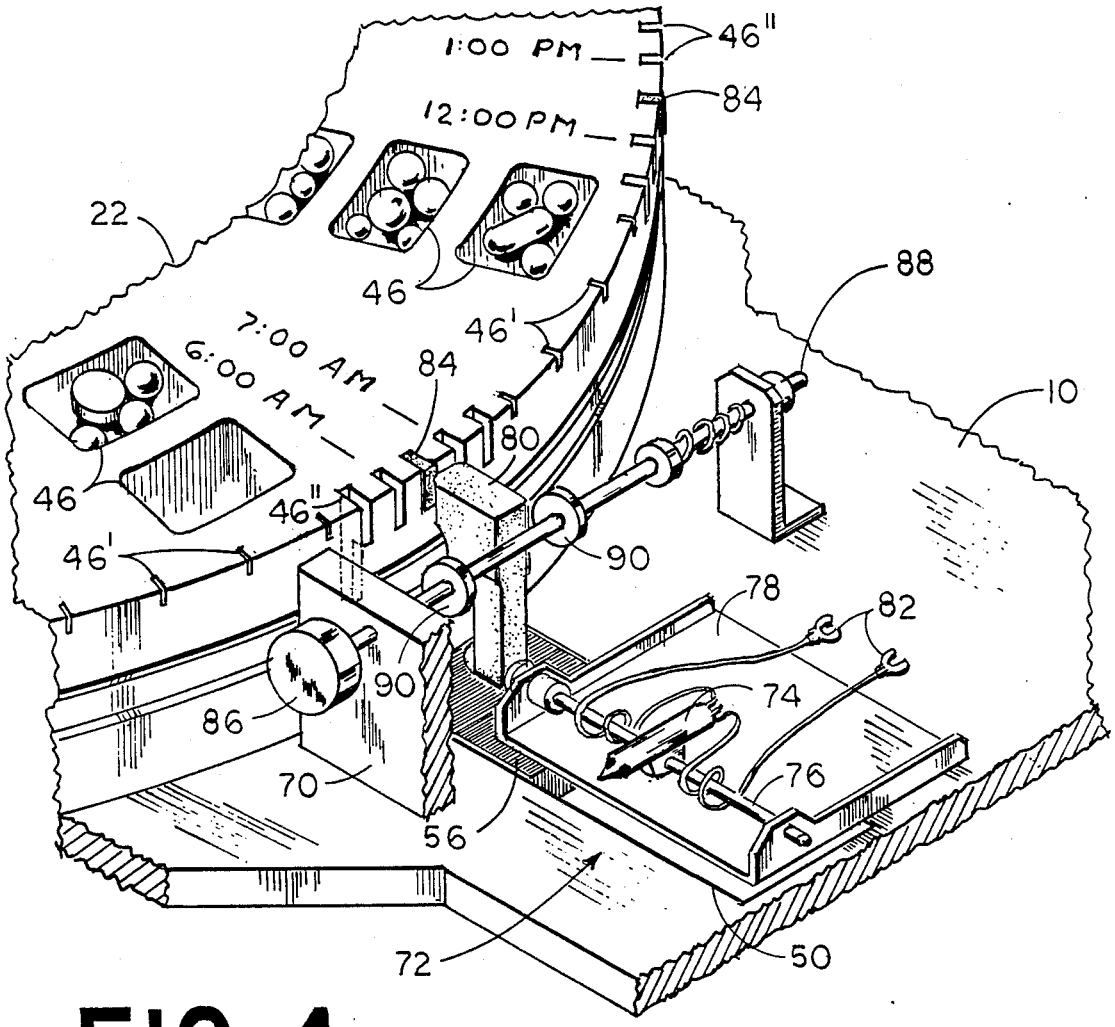
FIG. 4 is a still further enlarged fragmentary view, with portions broken away and omitted and showing a representative signal means.

As previously noted, the disc 22 is provided with a plurality of angularly spaced notches 46". Certain of these carry switch actuators or flags 84 of ferrous material; e.g., at notches designating times. See FIG. 4 showing an actuator at 6:30 a.m. On the basis of the six-hour intervals selected for the present disclosure, other actuators will be placed in notches at 12:30 p.m., 6:30 p.m., etc. The actuators are removable for selective fitting into other notches according to the time designations involved and preferably have friction fits with the notches. As seen, each actuator is close enough to the magnet 80 as to cause the magnet to follow the actuator until the mercury switch is tripped. This type of actuation is preferred because it trips the magnet without actual contact, thus making resetting of the switch easier, as by a reset button 86 affixed to a shaft 88 that has spaced stops 90, one at each side of the magnet to allow for tripping of the switch and resetting of the switch.

In the start-up phase of the apparatus, power to the clock motor may be started immediately. The pockets 46 are loaded while the top or cover is removed, the disc having been manually set at its start position in which the gate covers the dispensing slot 50. When the disc is set to the correct time of day, rotation of the disc and periodic and progressive dispensing will occur in the manner already described.

The many features and advantages of the invention will be clear from the foregoing. Additional features will be recognized by those versed in the art, as will many modifications and adaptations of the preferred embodiment disclosed herein, all without departure from the spirit and scope of the invention.

I claim:

1. A pill and like dispenser, comprising a base having a flat top, a disc carried by the base for rotation about a vertical axis and having upper and lower faces, the disc being superimposed over the base top with its bottom face closely overlying the base top, the disc further having therein a plurality of dosage pockets opening at both faces of the disc and arrayed in a mono-plane spiral pattern that proceeds centrifugally from the center portion of the disc, certain of the pockets comprising a plurality of multi-pocket sets arranged in radially-spaced apart relation, each set representing a calendar day and the pockets in each set being uniformly angularly spaced apart and representing successive time divisions of a calendar day, the time-division pockets of each set corresponding respectively to and lying respectively on the same radii as the time-divisions of the other sets, drive means carried by the base and having a driving connection to the disc for driving the disc at a constant rate and in the direction of centrifugal progression of the spiral, the relationship between the top of the base and the bottom face of the disc being such that a major portion of the top of the base closes the bottoms of the pockets, the base top having therein a radial slot having a width on the order of the lateral dimension of a pocket and extending from an inner end adjacent to the center of the disc to an outer end proximate to the locus of the outermost pocket, the base having an interior receiver portion and the slot opening upwardly to the bottom of the disc and downwardly to the receiver portion, dispensing control means carried by the base and including a slot-blocking gate extending lengthwise of the slot and flush with the top of the base and movable back and forth in the slot, and the control means further including mechanism for moving the gate progressively radially outwardly in the slot as the disc rotates and thereby to uncover the bottoms of the pockets sequentially in accordance with time divisions in a set and days in successive sets.

2. The dispenser according to claim 1, including means for interrupting radial movement of the gate when it reaches its end position.

3. The dispenser according to claim 1, in which the control means mechanism includes a gate-actuating spiral on the bottom face of the disc fashioned according to the spiral pattern of the pockets and the gate includes a follower engaging the gate-actuating spiral.

4. The dispenser according to claim 3, in which the gate-actuating spiral terminates in a circle about the axis of the disc for receiving the follower when the gate reaches its end position.

5. The dispenser according to claim 3, including means operative between the base and gate for biasing the gate toward its starting position.

6. The dispenser according to claim 1, including means operative between the base and gate for biasing the gate to its starting position.

7. The dispenser according to claim 1, in which the receiver portion includes a delivery exit opening to the exterior of the base.

8. The dispenser according to claim 1, in which each pocket is of such vertical dimension as to be capable of containing a plurality of pills.

9. The dispenser according to claim 1, including signal means carried by the base, and actuator means carried by the disc for actuating the signal means to signal the dispensing of a dosage from a pocket.

10. The dispenser according to claim 1, in which the disc carries a plurality of actuator means, one for each timed division represented by a pocket.

11. The dispenser according to claim 10, in which each actuator means is selectively angularly positionable in the disc to designate fractional times between the pockets on one radius and the pockets on a succeeding radius.

12. The dispenser according to claim 1, in which the sets are arranged consecutively in the spiral pattern and represent successive calendar days.

13. The dispenser according to claim 12, in which the sets are further contiguous so that the last time-division pocket of one set is immediately adjacent to the first time-division pocket of a next succeeding set.

* * * * *